United States Patent [19]

Norton

[11] 4,284,256

[45] Aug. 18, 1981

[54] SEQUENTIAL CHECKING OF RAILWAY CONTROL SIGNALS

[75] Inventor: David J. Norton, London, England

[73] Assignee: Westinghouse Brake and Signal Company Limited, London, England

[21] Appl. No.: 41,595

[22] Filed: May 23, 1979

[30] Foreign Application Priority Data

May 30, 1978 [GB] United Kingdom ..... 24015/78

[51] Int. Cl.[3] ..... B61L 27/00

[52] U.S. Cl. ..... 246/5; 246/187 C; 246/131

[58] Field of Search ..... 246/3, 4, 5, 187 C, 246/34 R, 34 B, 131, 132, 63 R, 63 A, 63 C; 371/24, 25, 60; 340/46; 324/73 R

[56] References Cited

FOREIGN PATENT DOCUMENTS 1489921 10/1977 United Kingdom ..... 246/5

OTHER PUBLICATIONS

IBM Technical Disclosure Bulletin, vol. 5, No. 9, Feb. 1963 "Checking Circuit", G. L. Smith.

*Primary Examiner*—J. D. Miller
*Assistant Examiner*—Reinhard J. Eisenzopf
*Attorney, Agent, or Firm*—Larson and Taylor

[57] ABSTRACT

An electronic or computer-based railway control system including further safety checks in addition to normal safety interlocking. The present system carries out checks to see that operations, such as print switching and signal setting, are carried out in the correct sequence for a given route having regard to the position and movement of a train as indicated by track circuits. In a computer-based system appropriate checking routines may be written into the computer soft-ware.

10 Claims, 4 Drawing Figures

SEQUENTIAL CHECKING OF RAILWAY CONTROL SIGNALS

This invention relates to railway control systems.

Safety checks in railway systems are of paramount importance since the occurrence of a wrong control signal or a fault in some part of the control system can result in the occurrence of a potentially disastrous situation. Conventionally electro-mechanical interlocking systems have been employed to ensure safety. The introduction of electronic control systems, such as, for example, the control system proposed in our U.K. Pat. No. 1,489,921, enables other safety checking methods to be carried into practice.

According to the present invention, railway control apparatus for controlling a plurality of signals and/or points in a railway system includes input means for receiving input signals from a plurality of devices, such as track occupancy circuits, signals and points, indicating the operative conditions of the devices, a control set responsive to the indicating signals for generating control signals for governing the movement of a train in the railway system, and checking means for checking that control signals are generated in a correct sequence having regard to the indicated movement of the train.

Figure 1:
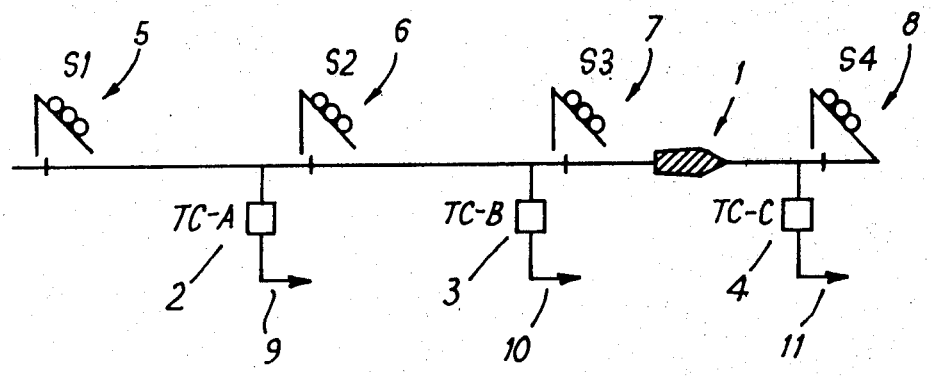
Figure 2:
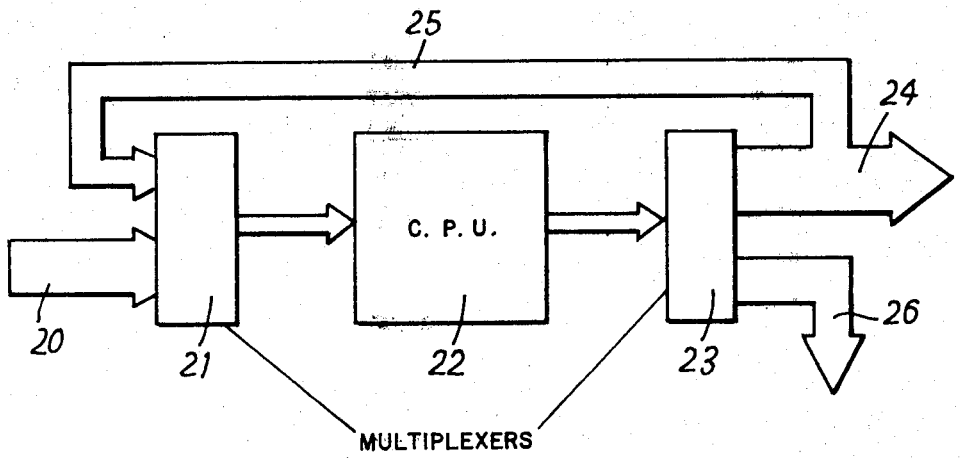
Figure 3:
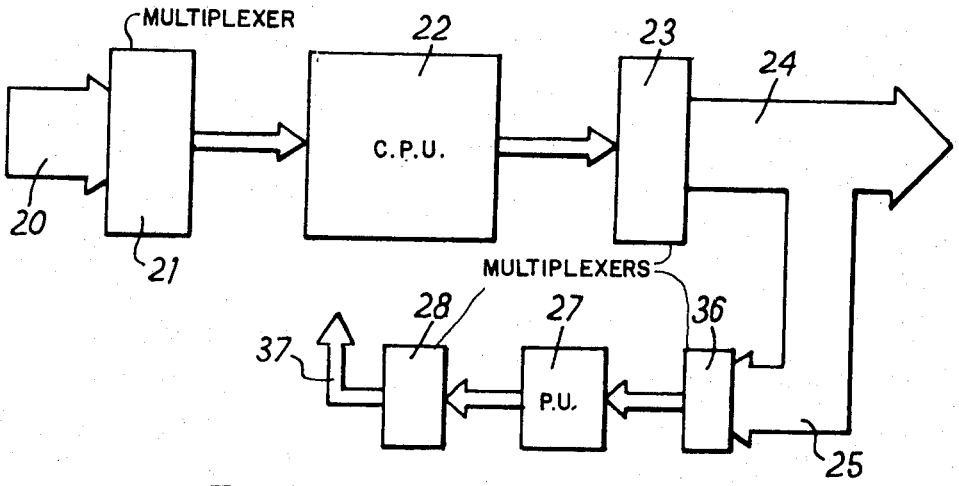
Figure 4:
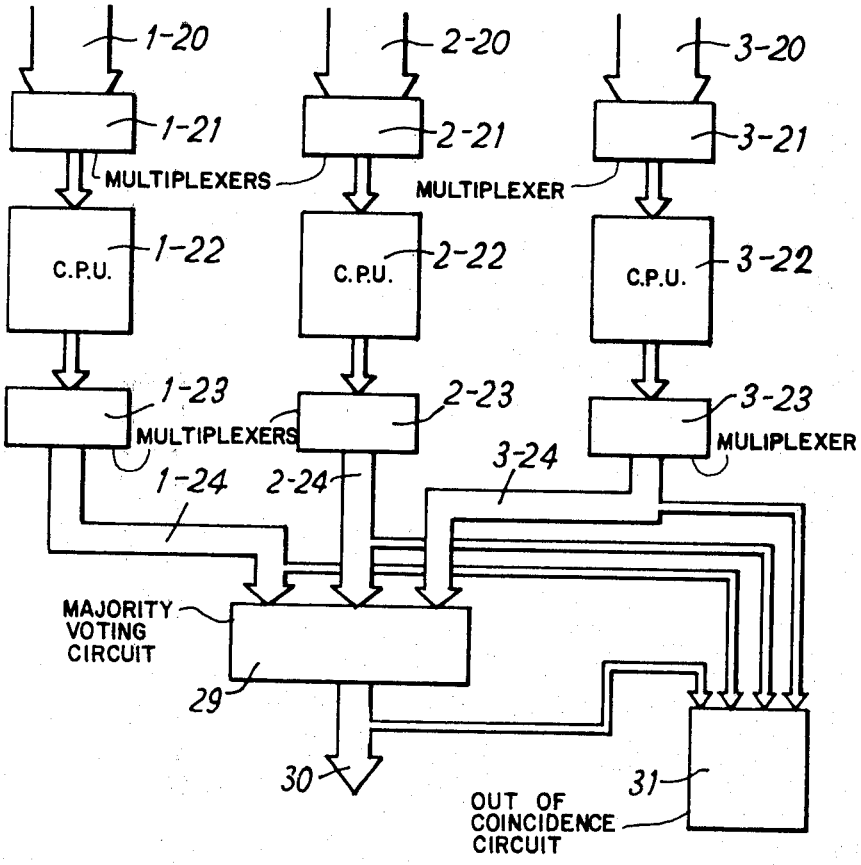

In order that the invention may be fully understood and readily carried into effect, two preferred methods of sequential operation safety checking will now be described by way of example, with reference to the accompanying drawings in which:

FIG. 1 is a schematic diagram of a length of railway track with signals and track occupancy circuits, FIG. 2 is a schematic diagram of a computer control sub-system employing a first method of sequential operation checking, FIG. 3 is a schematic diagram of a similar control sub-system employing a second method of sequential operation checking, and FIG. 4 is a schematic diagram of a triple redundancy control system with a safety recorder.

Referring now to FIG. 1, a train, schematically represented at reference 1, is shown travelling along a length of track including three track sections A, B and C having track occupancy circuits 2, 3 and 4 respectively and signals 5, 6, 7 and 8. Before the train enters the track, all the signals show green and the track circuits indicate unoccupied. The train moving from left to right in the diagram enters track section A and the track circuit 2 transmits a track occupied signal to control apparatus (not shown) via a control link 9. In response, the control apparatus changes the signal 5 to red.

The train next enters track section B and track circuit 3 transmits a track occupied signal via control link 10 while track circuit 2 reverts to track unoccupied. In response, signal 6 is changed to red and signal 5 to amber. When the train enters track section C, as shown in the diagram, track circuit 4 transmits track occupied via control link 11 and track circuit 3 changes to track unoccupied. The control apparatus changes signal 7 to red, signal 6 to amber and signal 5 to green. Thus, as the train progresses from section to section the track circuits indicate its location and the signal immediately behind the train shows red, the next signal shows amber, the next green and so on. The signal sequence behind a train is given for example only, and different sequences may be employed to maintain various separation between trains.

The control apparatus operates to switch the signals according to a predetermined sequence so that the control apparatus output signals may be monitored and checked for correct sequencing in order to determine whether any faults have occurred. For example, in the above description in relation to FIG. 1, a red aspect must be shown by the signals 5, 6, 7 and 8 in that order. If signal 6 does not show red before signal 7, then it may be concluded that a fault has occurred in respect of the controls of signal 7.

This principle of sequentially checking control outputs can be applied to all control output, that is the control signals for points and points and signals together.

A first sequential checking method will now be described with reference to FIG. 2, which shows a data highway 20 carrying indicating signals from track signals, points and signals on a plurality of parallel lines which connect to an input multi-plexing circuit 21 in the data processing equipment of a control apparatus. The parallel indication signals are converted to serial format and supplied to a processing unit 22 which performs appropriately programmed control functions to generate output control signals which are fed, also in serial format, to output multi-plexing unit 23. The control signals appear in control data highway 24, comprising a plurality of parallel control lines which fan out and connect to the appropriate controlled elements, i.e. signals and points. Each output control line in highway 24 is tapped and fed back via feedback data highway 25 to the input of the control equipment.

The processing unit 22 is also programmed to carry out sequential checking functions, basically as described above, by correlating the fedback output signals with the input indicating signals. The processor 22 is thus able to determine whether from the sequence of a given set of input signals, the correct output signals are being generated, or for a given set of output signals whether the correct sequence of events is being indicated from the track. Thus the processor 22 is able to detect failures in the processing unit 22, the input and output multiplexers 21 and 23, and the controlled elements themselves. On detecting a failure, the processor 22 produces a control signal output on a further highway 26 which is directed to disable part or all of the control system containing the detected failure.

The data processing equipment shown may be only one sub-system in a redundant control system comprising a plurality of such sub-systems.

FIG. 3 illustrates a second sequential operation checking method, where like parts have like references compared to FIG. 2. According to this checking method, the feedback data highway 25 is connected to the input multi-plexing unit 36 of a separate computing system. The processing unit 27 of this computer is programmed to perform the sequential checking functions, its outputs which indicate failures being routed through output multi-plexer 28 to the signal highway 37 to control the disablement or shut-down of that part of the system containing the fault.

Again, the apparatus shown in FIG. 3 may be one sub-system of a redundant control system.

Where the apparatus described above are sub-systems in a redundant control system, the control signal outputs from all the sub-systems are connected to a majority voting circuit to determine the correct control signal should there be disagreement. FIG. 4 shows such a redundant control system in which like parts are given the same references as in FIGS. 2 and 3.

In FIG. 4 the control system consists of three similar sub-systems in parallel, the parts of which are respectively denoted by prefixes 1-, 2-, and 3-. The three output control signals 1–24 and 3–24 are connected to a majority voting circuit 29 which produces an output signal 30 upon which a majority of the sub-systems agree.

Additionally in FIG. 4, the outputs of the sub-systems, that is signals 1–24, 2–24 and 3–24, and the output 30 of the voting circuit are connected to a "black box" type recorder 31. This type of recorder usually maintains its record for a predetermined period, say, 24 hours, so that in the event of accident occurring, the recording may be replayed to determine if any of the recorded signals contributed to or caused the incident. The recorder inputs may comprise other signals as well as the outputs referred to.

The recorder may also be applied to the other equipment configurations described.

Having thus described our invention what we claim is:

1. Railway control apparatus for generating control signals for controlling a plurality of signalling lamps and change points in a railway system, said apparatus including input means for receiving status signals from a plurality of devices which monitor the railway system, said status signals indicating the operative conditions of the devices, a control set responsive to the indicating signals for generating control commands for governing the movement of a train in the railway system, and control command sequence checking means for checking that control commands are generated in a correct sequence with regard to the indicated movement of the train.

2. Railway control apparatus as claimed in claim 1, wherein the control set comprises a computer.

3. Railway control apparatus as claimed in claim 1, wherein the control set comprises a plurality of parallel computers, each capable of independently generating control commands and means responsive to the control commands to pass the signals only when a majority of the commands or all the commands agree.

4. Railway control apparatus as claimed in claim 3, wherein there are three computers.

5. Railway control apparatus according to claim 1 or claim 2, wherein the control signals generated by the control set are fed back to the input means and the checking means comprises part of the control set.

6. Railway control apparatus according to any of claims 1 to 4, wherein the control signals are supplied to independent checking means.

7. Railway control apparatus according to claim 5, wherein the checking means is responsive to an incorrect sequence of control signals to disable all or part of the control set responsible for the incorrect sequence.

8. Railway apparatus according to claim 1 or claim 2, wherein the checking means comprises a computer programmed to be responsive to an incorrect control signal sequence.

9. Railway apparatus according to claim 1 or claim 2, wherein the or each control set output is recorded by recording means.

10. Railway apparatus according to claim 1 wherein said devices comprise track occupancy circuits, signalling lamps and change points.

* * * * *